US007012498B2

(12) United States Patent
Van Heerden

(10) Patent No.: US 7,012,498 B2
(45) Date of Patent: Mar. 14, 2006

(54) FUSE HOLDER FOR A PLURALITY OF FUSES

(76) Inventor: Dorrin Van Heerden, 12 Ripplemead Road, Cambridge, 5201 East London (ZA)

( * ) Notice: Subject to any disclaimer, the term of this patent is extended or adjusted under 35 U.S.C. 154(b) by 204 days.

(21) Appl. No.: 10/488,816

(22) PCT Filed: Aug. 28, 2002

(86) PCT No.: PCT/ZA02/00133

§ 371 (c)(1),
(2), (4) Date: Mar. 5, 2004

(87) PCT Pub. No.: WO03/021619

PCT Pub. Date: Mar. 13, 2003

(65) Prior Publication Data

US 2004/0239473 A1 Dec. 2, 2004

(30) Foreign Application Priority Data

Sep. 6, 2001 (ZA) ..... 2001/7366

(51) Int. Cl.
*H01H 85/56* (2006.01)
*H01H 85/60* (2006.01)

(52) U.S. Cl. ..... 337/286; 337/289; 337/284; 337/285; 337/176; 337/179

(58) Field of Classification Search ..... 337/171–179, 337/283–289; 361/104, 626, 642, 646, 833, 361/835, 837; 439/250, 366
See application file for complete search history.

(56) References Cited

U.S. PATENT DOCUMENTS 1,894,056 A * 1/1933 Pittman et al. ..... 337/285
1,953,392 A * 4/1934 Carlisle ..... 337/285
1,965,391 A * 7/1934 Pittman et al. ..... 337/285
2,192,710 A * 3/1940 Lemmon ..... 337/288
2,204,298 A * 6/1940 Carlisle ..... 337/285
2,209,396 A * 7/1940 Fox ..... 337/288
2,210,502 A * 8/1940 Schultz et al. ..... 337/287
2,211,974 A 8/1940 Hendricks
2,217,589 A * 10/1940 Fox ..... 337/288
2,247,700 A * 7/1941 Ramsey ..... 337/288

(Continued)

FOREIGN PATENT DOCUMENTS

EP 676788 A2 * 10/1995

(Continued)

*Primary Examiner*—Anatoly Vortman
(74) *Attorney, Agent, or Firm*—Meyertons, Hood, Kivlin, Kowert & Goetzel., P.C.; Eric B. Meyertons

(57) ABSTRACT

A fuse holder assembly (1) is provided having at least two electrically insulated fuse housings in the form of passages (5, 33) associated with the body and each of which is adapted to receive a fuse (6) held under tension therein by means of an elongate tension member (7) and cooperating spring loaded tensioning element. The fuse housings have separate intermediate contacts (16, 17, 34, 35) at one end adapted for sequential connection to a circuit contact (20) by way of a rotatable conductive arm (18, 37) spring loaded to effect rotation of the arm from one intermediate contact to the other. Stop means (22, 23, 36 39) for temporarily maintaining the arm in association with one intermediate contact against the spring loading of the arm acts to release the arm for movement towards a subsequent intermediate contact only when the spring loaded tensioning element has substantially reached the end of its operative movement to clear the blown fuse.

10 Claims, 5 Drawing Sheets

U.S. PATENT DOCUMENTS

| | | | | | |
|---|---|---|---|---|---|
| 2,265,766 | A | * | 12/1941 | Schultz et al. | 337/287 |
| 2,284,845 | A | * | 6/1942 | Rawlins et al. | 337/286 |
| 2,307,208 | A | * | 1/1943 | Fox | 337/286 |
| 2,348,029 | A | * | 5/1944 | Smith, Jr. | 337/286 |
| 2,348,034 | A | | 5/1944 | Stotenbur | |
| 2,367,090 | A | * | 1/1945 | Birkenmaier | 337/286 |
| 2,378,582 | A | | 6/1945 | Salter | |
| 2,437,310 | A | * | 3/1948 | Werber | 337/285 |
| 2,464,299 | A | * | 3/1949 | Fox | 337/288 |
| 2,519,078 | A | * | 8/1950 | Schultz | 337/287 |
| 2,563,558 | A | * | 8/1951 | Schultheiss | 337/286 |
| 2,663,778 | A | * | 12/1953 | Matthews et al. | 337/171 |
| 4,008,452 | A | * | 2/1977 | Cameron | 337/284 |
| 4,321,575 | A | * | 3/1982 | Koszewa et al. | 337/168 |
| 5,796,326 | A | * | 8/1998 | Benito | 337/169 |
| 5,861,793 | A | * | 1/1999 | Hatton | 337/229 |
| 6,531,948 | B1 | * | 3/2003 | Mennell | 337/211 |

FOREIGN PATENT DOCUMENTS

| | | | |
|---|---|---|---|
| GB | 516 197 | A1 | 12/1939 |
| GB | 2 299 718 | A1 | 10/1996 |

* cited by examiner

FUSE HOLDER FOR A PLURALITY OF FUSES

FIELD OF THE INVENTION

This invention relates to a fuse holder for a plurality of fuses and, more particularly, to a fuse holder particularly, but not exclusively, for use in high tension applications. Still more particularly the invention relates to a fuse holder of the general type in which a mechanism is included for automatically coupling at least a second fuse into an electrical power supply circuit in the event that a first fuse blows in order to restore the power supply automatically.

BACKGROUND TO THE INVENTION

Fuses are used extensively in high voltage electrical networks in order to protect the electrical equipment in the network from damage caused by surges through the system, generally occasioned by short-circuits or overloads. It does occur that a very temporary surge will have the effect of causing a fuse to blow under circumstances in which the cause of the temporary surge is unlikely to repeat itself soon, if ever. In the absence of a fuse holder assembly that can automatically connect to a second, and possibly subsequently a third fuse connected into the electrical power supply circuit in parallel, the consumers supplied through that particular circuit will be subjected to a power interruption that can be extremely inconvenient and often harmful. Also, the labour and cost involved in replacing a fuse is generally considerable.

As an answer to this problem U.S. Pat. No. 5,796,326 to Derick Benito and its counterparts including South African patent number 96/2576, describe a fuse holder assembly in which, in the described preferred form of the invention, a carrier for a plurality of fuses is rotatably mounted relative to contacts in the circuit so that a second, and thereafter a third fuse will be connected into an electrical supply circuit sequentially in the event that the first or second fuse blows as the case may be. This earlier patent also describes a fuse holder in which a rotatable arm is employed to firstly connect with a first stationary fuse and thereafter with a second stationary fuse and optionally also subsequently a third stationary fuse.

Whilst these fuse assemblies operate effectively from a mechanical point of view, in at least some applications, particularly those involving high voltages, there is a need for the assembly to include means for ensuring that a blown fuse is properly cleared, and the inevitable arc that occurs when a fuse blows, has died down adequately, before the next fuse is connected into the circuit as a replacement.

OBJECT OF THE INVENTION

It is, accordingly, an object of this invention to provide a fuse holder assembly in which a plurality of fuses are arranged for sequential connection into a circuit automatically in the event that one fuse blows and wherein adequate provision is made to enable a blown fuse to be cleared adequately prior to a subsequent fuse being automatically connected into the circuit.

SUMMARY OF THE INVENTION

In accordance with this invention there is provided a fuse holder assembly comprising a body providing at least two electrically insulated fuse housings in the form of passages associated with the body and each adapted to receive a fuse held under tension therein by means of an elongate tension member, the fuse housings having electrical contact means connected together at one end to a common first circuit contact for connecting one end of each fuse assembly into a circuit and at the other end with separate intermediate contacts adapted for sequential connection to a second circuit contact by way of a rotatable conductive arm spring loaded to effect rotation of the arm from one intermediate contact to another; stop means for temporarily maintaining the arm in association with one intermediate contact against the spring loading thereof, the stop means being releasable to allow the arm to rotate to a following intermediate contact after a fuse associated with the particular intermediate contact with which the arm communicates has blown; a tensioning device associated with each passage at the end thereof corresponding to the intermediate contacts and comprising a spring loaded tensioning element for engaging the tension member associated with a fuse and adapted to move the tension member in a direction outwards of the associated passage in the event of the associated fuse being blown; the assembly being characterised in that the stop means and spring loaded tensioning element are arranged such that the stop means only releases the arm for movement towards a subsequent intermediate contact when the spring loaded tensioning element has substantially reached the end of its operative movement to clear the blown fuse.

Further features of the invention provide for the arm to carry a cooperant contact preferably in the form of a generally squat cylindrical contact at its free end for cooperation with an associated intermediate contact; for the spring loaded tensioning element in each case to be a pivotally mounted element whereof the pivotal axis is offset from the axis of the associated fuse passage and the free end is, in the operative tension imparting condition, positioned roughly coaxial with the passage and is engaged by the tension member so as to move the latter out of the fuse passage when the tensioning member is released in consequence of the associated fuse blowing; and for the intermediate contact, in each case, to be mounted to move in unison with the associated spring loaded tensioning element about a pivotal mounting thereof with the intermediate contact having a surface orientated in a plane offset from said passages and at generally right angles to the axis of rotation of the spring loaded tensioning element; for the said axis of rotation of the spring loaded tensioning elements to be either coincident with the axis of the intermediate contact or offset relative thereto in the general direction in which the associated passage extends; and for the stop means to assume the form of an upstanding stop fixed to the associated intermediate contact so as to cooperate with the squat cylindrical contact carried by the arm to release the arm only once the spring loaded tensioning element has moved to pull the tension member out of the associated fuse passage.

Still further features of the invention provide for the fuse assembly to be a dropout fuse assembly; for the final fuse in the sequence to be arranged to cause dropout of the fuse assembly once a final fuse has blown; for the rotatable arm to be carried at one end of a rotatable axle assembly, the other end of which cooperates with a catch that is spring loaded to its open position and held in a closed position by the axle assembly and wherein the spring loaded catch operatively holds the dropout fuse assembly in an extended operative condition but causes collapse of a link held in its operative position by said spring loaded catch when the catch is released; and for the dropout fuse assembly to be adapted to be orientated in a generally horizontal position in use.

In order that the above and other features of the invention may be more fully understood one embodiment of the invention will now be described with reference to the accompanying drawings.

DETAILED DESCRIPTION WITH REFERENCE TO THE DRAWINGS

Figure 1:
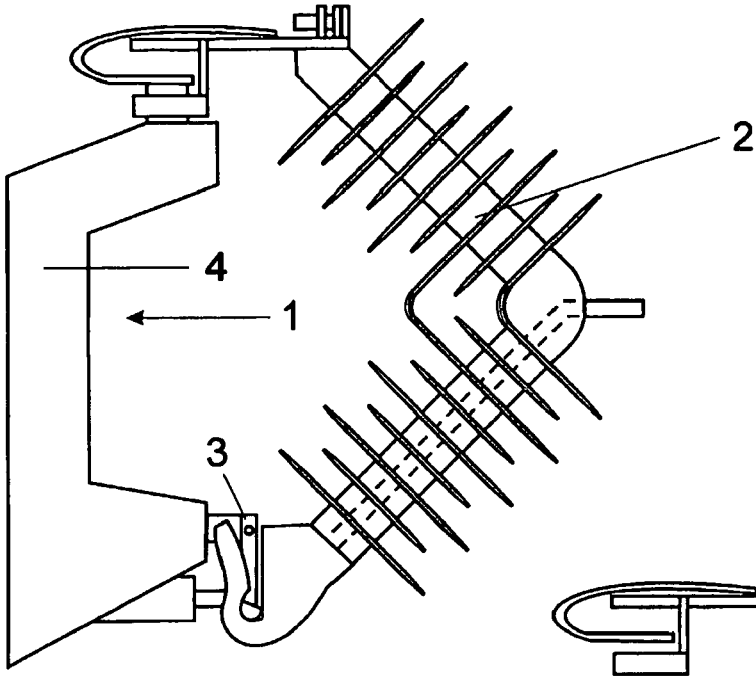
FIG. 1 is a schematic elevation of one embodiment of dropout fuse assembly according to the invention in an operative position on an insulator assembly of a high tension power line.
Figure 2:
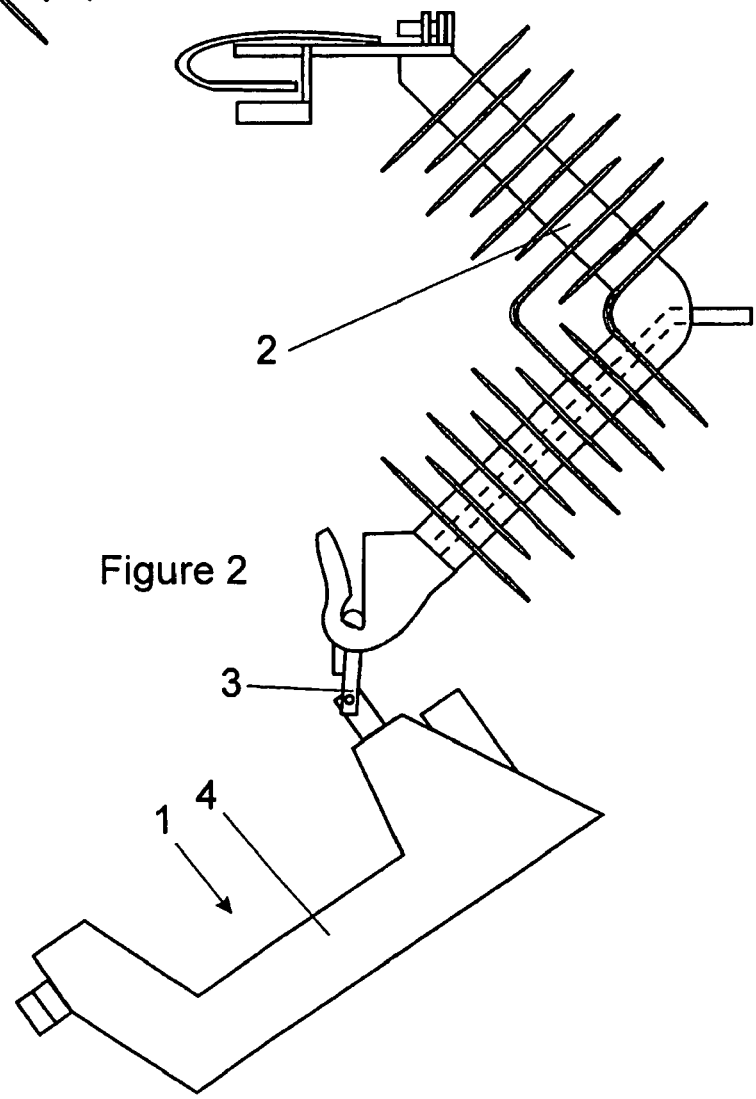
FIG. 2 is a similar elevation illustrating the fuse assembly in the dropout position.

In the embodiment of the invention illustrated in the accompanying drawings, the invention is applied to a fuse holder assembly, generally indicated by numeral (1), that is, in this case, adapted for use with a bifurcated insulator (2) so that the insulator is orientated in a generally vertical plane in the operative position, as illustrated in FIG. 1. The fuse assembly includes a collapsible link (3) that is adapted to collapse, in generally known manner, when a fuse (in the presently practised technology, the only fuse), has blown, the so that the fuse assembly hangs from the one end in the manner illustrated in FIG. 2 when the fuse, in the context of this invention the last fuse, has blown.

The fuse holder has a body (4) of electrically insulating material and the body has two laterally spaced, parallel elongate passages (5) therethrough for accommodating two mutually insulated fuses (6) held in tension therein by longitudinally extending, electrically conductive tension members (7), typically stranded stainless steel cable. The fuses are located towards one end of the passages and have headed connectors (8) electrically connected together and to a common circuit terminal (9).

Figure 5:
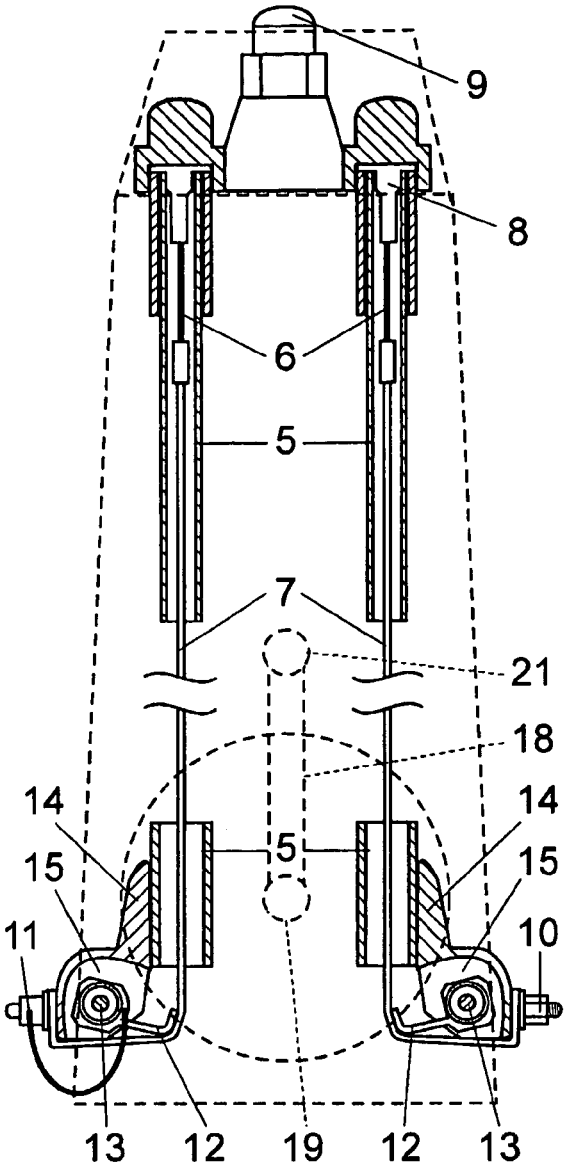
FIG. 5 is a schematic side view showing the two fuse passages and tensioning arrangement with the body being shown in dotted lines for purposes of perspective and clarity of illustration.
Figure 6:
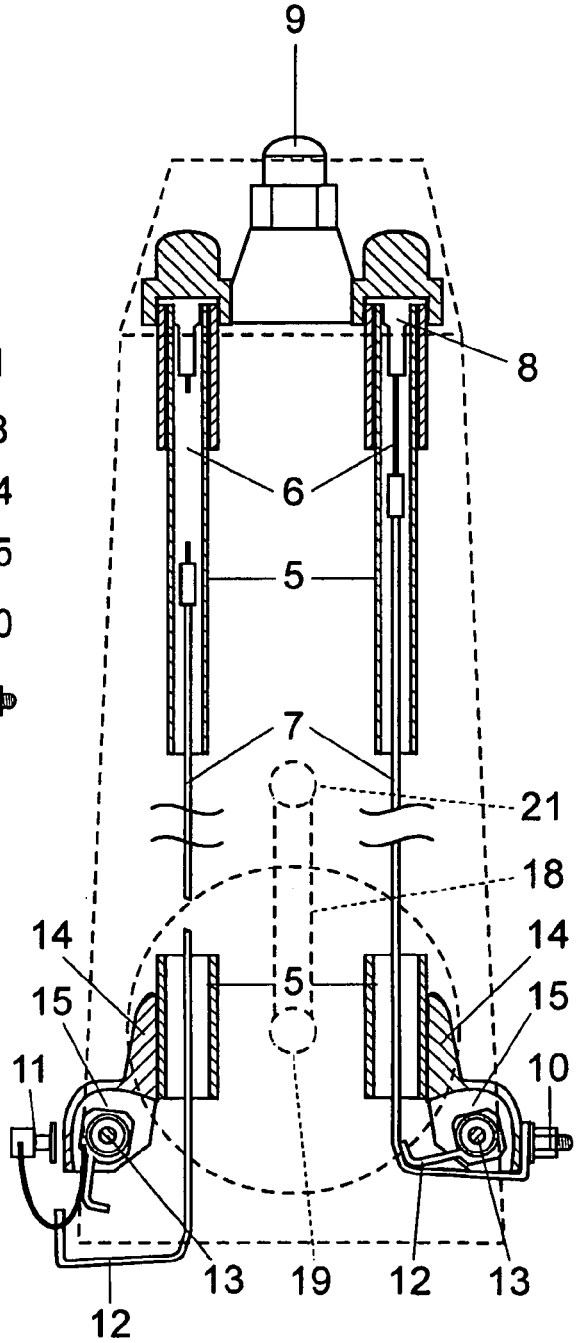
FIG. 6 is a view similar to FIG. 5 but showing the one fuse blown.
Figure 7:
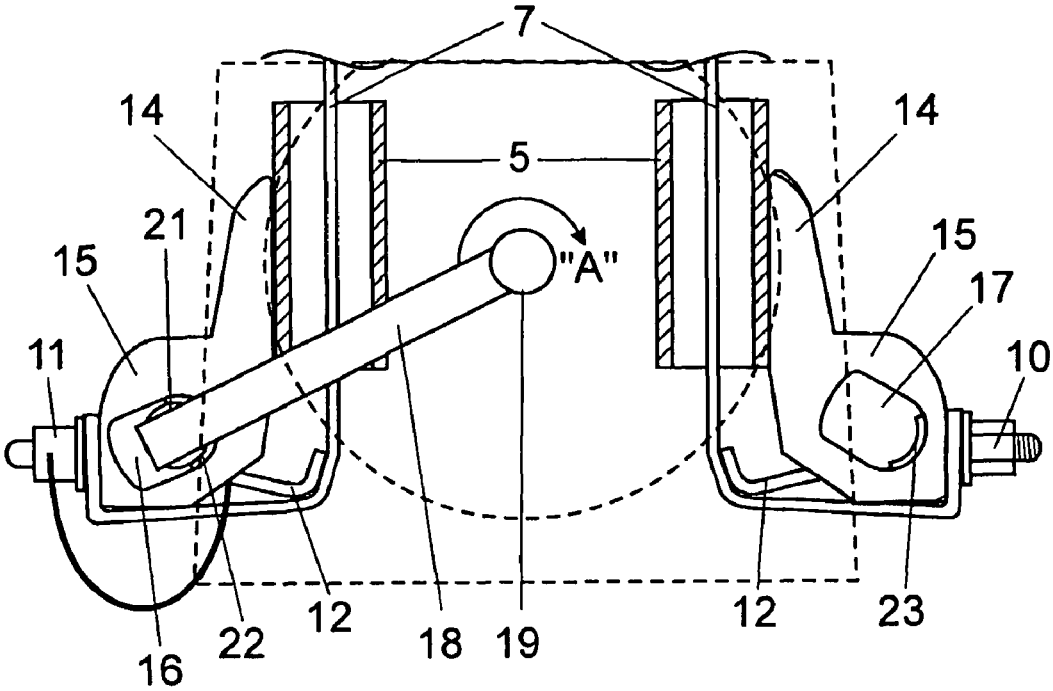
FIG. 7 is a detailed side view showing the association of the intermediate contacts and arm with the arm cooperating with an intermediate contact associated with a first fuse.

At the opposite end the tension members are anchored by fasteners (10) and (11) associated with tensioning elements (12) of basically known type and which comprise a shaped plate rotatable about a pivot (13) (see FIGS. 5 and 6) laterally offset from the relevant passage axis and arranged so that the plate can rotate between a position in which it projects across the line of the passage (as illustrated in FIG. 5) and a position in which the plate extends in a direction generally away from the passage as illustrated in the left-hand part of FIG. 6.

Each of the plates conveniently has a central locating groove (not shown) for locating the tension element approximately axially within the passage when the plate projects across the line of the passage. The plate is spring biased to the second position described above so that when rotated to the first described position against the spring loading by virtue of the tension member (7) being tightened and anchored by the fasteners (10) and (11) the tension member is held under the required degree of tension. Each tensioning element is carried by an electrically conductive carrier (14) having a pair of spaced flanges (15) between which the spring loaded tensioning member is pivotally mounted. This technology as applied to a holder for a single fuse, is known.

The axes of the pivots whereby the tensioning elements are mounted extend in a direction at right angles to the plane that includes the axes of the two passages. On the outside of the flange (15) and directed outwardly of the fuse assembly is an intermediate contact (16) and (17) in each case arranged substantially coaxially with the associated pivot (13) and adapted to rotate in unison with its associated tensioning element.

Figure 3:
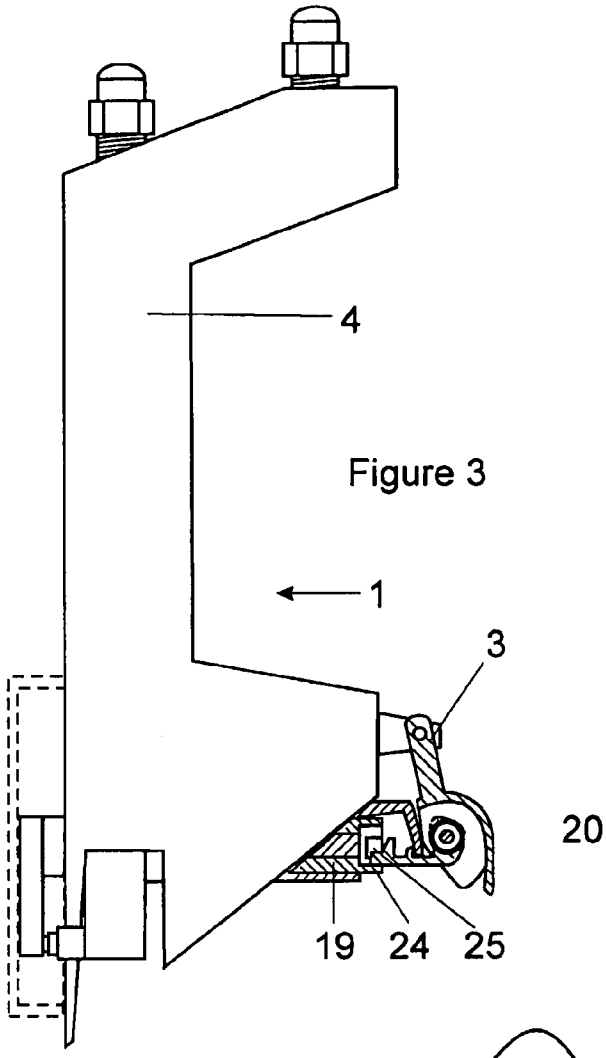
FIG. 3 is an enlarged elevation of the fuse assembly itself illustrating the dropout catch assembly in section.
Figure 4:
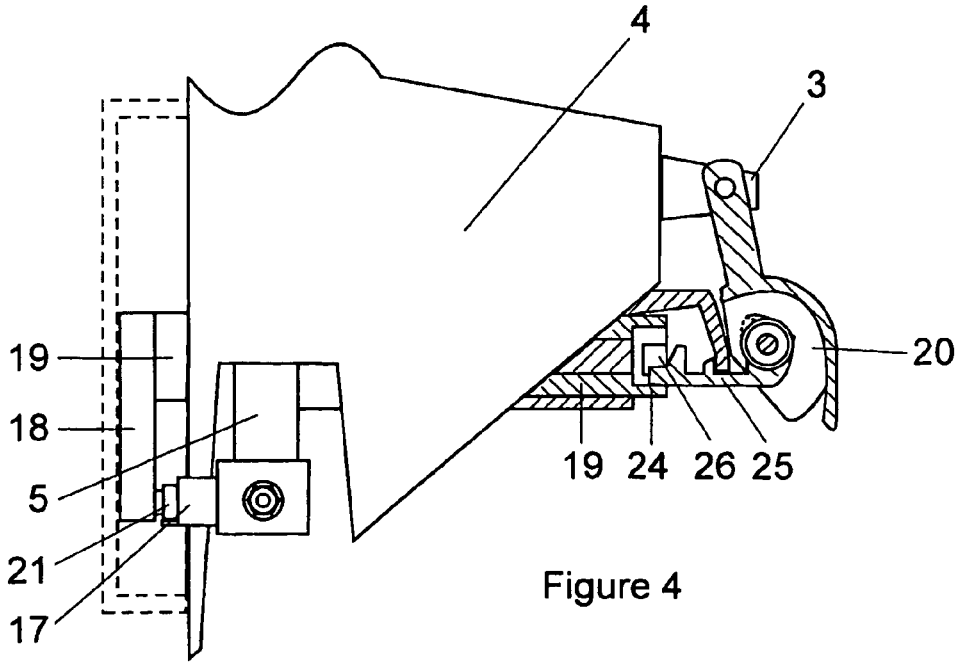
FIG. 4 is an enlarged detailed view showing the dropout catch assembly illustrated in FIG. 3.

These intermediate contacts are adapted to be selectively connected by way of a rotatable electrically conductive arm (18) and its associated axle mechanism (19) to the other circuit contact (20) (see FIGS. 3 and 4) associated with the collapsible link (3).

The electrically conductive arm has a squat cylindrical contact (21) at its free end. The arm (18) can thus rotate to connect either one of the two fuses into the circuit. The axle assembly includes spring means biasing the arm towards rotation in a clockwise direction as viewed in FIGS. 5 to 9; in other words, from the one intermediate contact (16) towards the other (17), and beyond the latter in the same direction.

In this embodiment of the invention the one intermediate contact (16) is adapted to connect the arm to the first fuse that is to blow and this contact has an upstanding stop formation (22) (see FIGS. 7 to 9) is extending part way around the periphery of the area that accommodates the cylindrical contact (21) carried by the arm. The stop formation rotates in unison with the intermediate contact and its associated tensioning element (12). This arrangement is such that, with the tensioning element (12) is in its normal operative position the cylindrical contact on the arm is held captive by the stop formation (22) as shown clearly in FIG. 7.

Immediately the first fuse blows the associated tensioning element (12) rotates about its pivot (13) so as to pull the tensioning member (7) out of the associated passage. The stop formation (22) is, however, configured so that the arm is retained in position until the tensioning member has substantially completed its arc of movement to the position illustrated on the left-hand side of FIG. 8. By this time the blown fuse has been cleared and, generally speaking, the entire tensioning member (7) has been thrown away from the fuse assembly. Only then is the arm released by the stop formation so that it can rotate (in the direction indicated by arrow "A" in FIG. 7) under the spring loading thereof to the second intermediate contact (17) as shown clearly in FIG. 8. It is to be noted that in the case of the first fuse the fastener (11) is a spring clamp operated by a spring (11*a*) attached in off-centre manner to the tensioning member so as to release the tensioning member completely.

Figure 8:
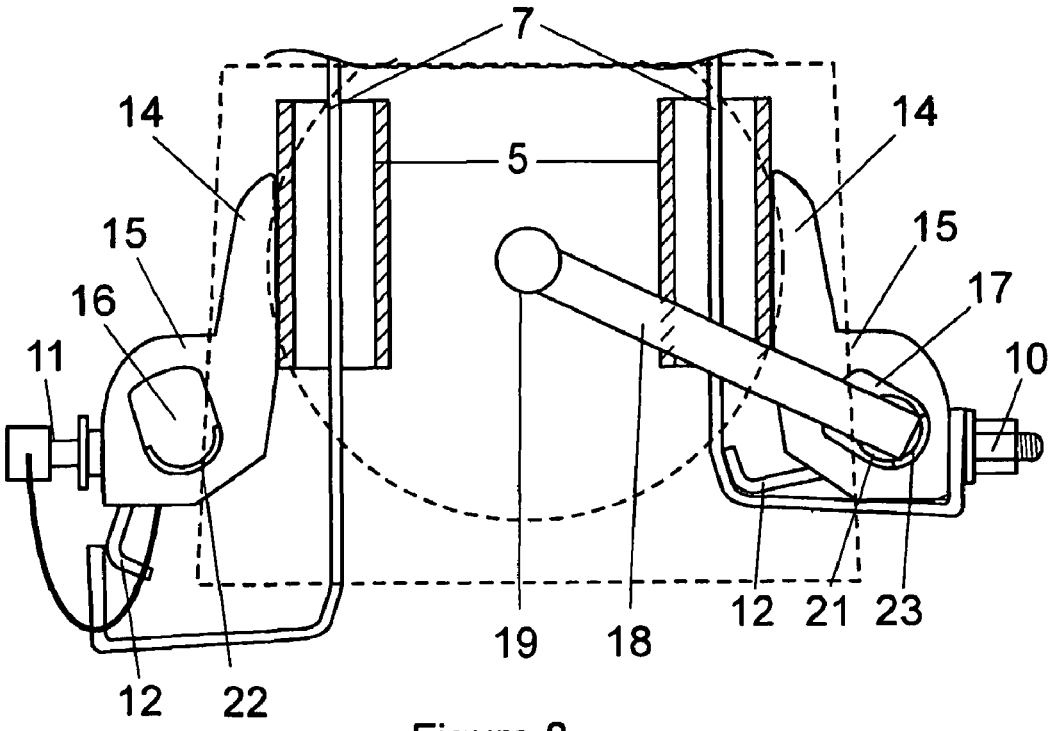
FIG. 8 is a view similar to FIG. 7 but showing the arm rotated to a position in which it co-operates with the intermediate contacts of the second fuse.

The second intermediate contact has a slightly differently configured stop formation (23) that is arranged to arrest of the movement of the arm as it arrives from the first intermediate contact and hold it captive, by virtue of its own spring loading, in contact with the second intermediate contact (17). This situation too, is illustrated in FIG. 8.

Figure 9:
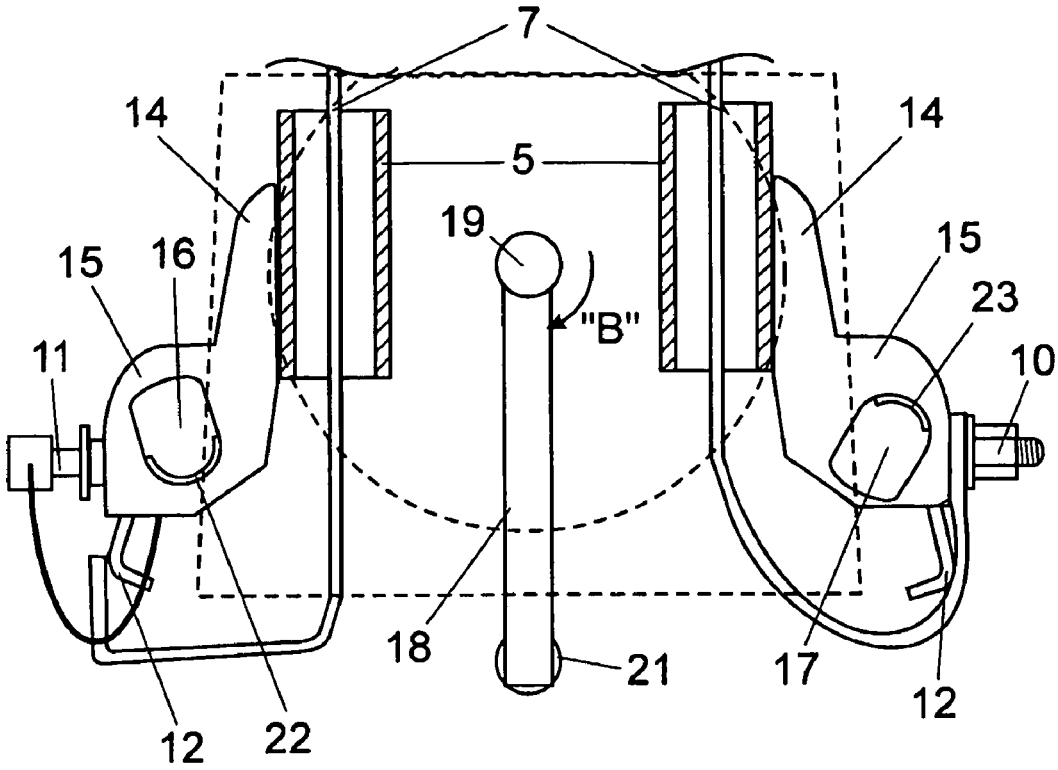
FIG. 9 is a view similar to FIG. 8 but illustrating a condition in which the arm has been released to release the catch and cause the dropout mechanism to operate after the second fuse has blown; and, FIG. 10 is a view similar to FIG. 7 but illustrating an alternative pivotal arrangement of the tensioning elements and stop formations that may provide for a different time delay.

When the second fuse blows and its associated tensioning element (12) operates to clear the blown fuse, the second intermediate contact rotates in unison with the tensioning element to release the arm to move under its spring loading beyond the second intermediate contact and generally to a position illustrated in FIG. 9 and indicated by arrow "B".

In the latter position a retainer skirt (24) that forms part of the axle assembly and which rotates in unison with the arm, reaches a position in which a catch member (25) that is spring loaded and holds the collapsible link (3) in its operative position, is released. This results from the alignment of a notch (26) in the retainer skirt with the catch (25) to release it from its otherwise captive state and thereby create a collapse of the collapsible link and the dropping out of the fuse assembly to its non-functional position illustrated in FIG. 2.

It will be understood that the fuse holder assembly described above will operate effectively to delay the movement of the arm to connect with a subsequent fuse by an amount of time adequate to enable the blown fuse to be cleared. The exact configuration of the stop means can be varied widely and need as in the embodiment described above. However, it is envisaged, that release of the arm to enable a subsequent fuse to be connected into the circuit will generally involve the delay of the commencement of such movement until the associated tensioning member has operated to clear the blown fuse and allow the any arc to die down.

Figure 10:
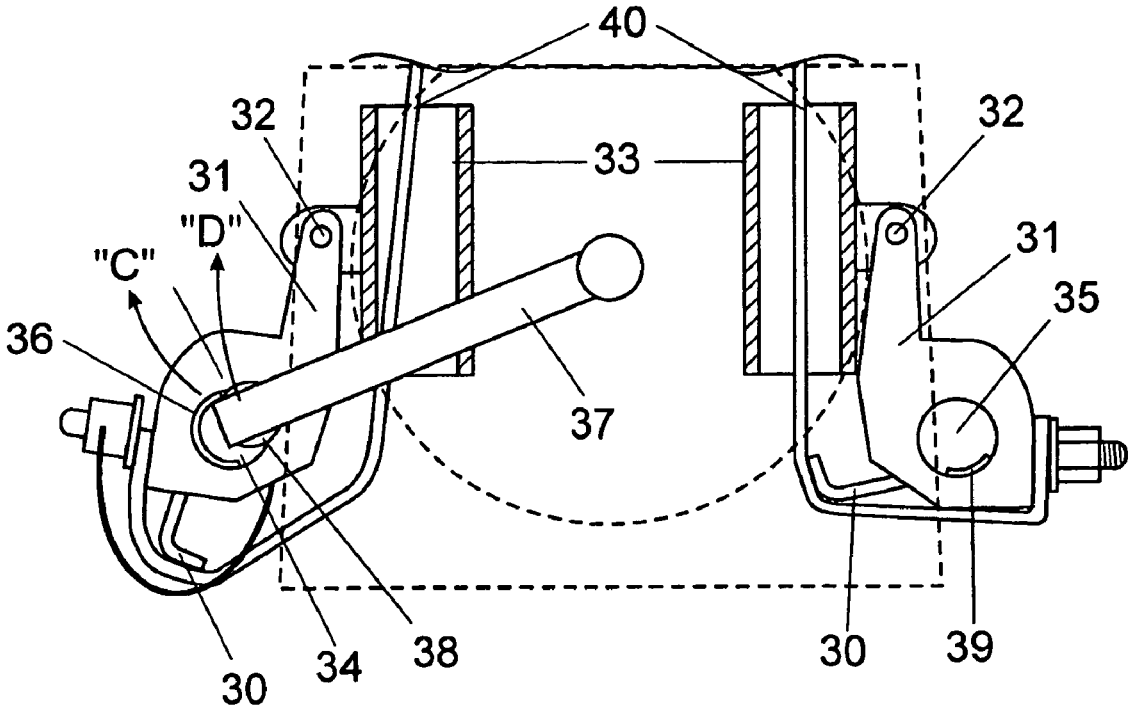

One particular alternative arrangement whereby different and, depending upon design considerations, prolonged delays can be achieved is illustrated in FIG. 10. In this arrangement the tensioning elements (30) are for each spring biased in the manner indicated above relative to electrically conductive pivotal carriers (31) that are mounted by means of pivots (32) to the passages (33) externally thereof. The pivot axes are located a short distance towards the remote end of the holder as illustrated in FIG. 10 and extend at right angles to the plane containing the axes of the two passages as in the embodiment described above. The pivotal carriers (31) thus replace the fixed carriers (14) described above.

The intermediate contacts (34) and (35) are, however, not fixed relative to the tensioning elements but are fixed relative to the pivotal carriers. As indicated by arrow "C", when the first fuse blows, the tensioning element will firstly move under its own spring loading to extract the blown fuse and tension member, and thereafter, the entire carrier, intermediate contact and stop formation (36) rotate in unison about the pivot (32) with the movement being initiated by the impact of the tension element arresting at the end of its movement and the spring loading of the rotatable electrically conductive arm (37) that is substantially identical to that described above.

FIG. 10 illustrates the position of the electrically conductive arm part way through its release both for clarity of illustration and to illustrate the movement of the various components. Movement of the squat cylindrical contact (38) on the conductive arm is indicated by arrow "D". It will be noted that the two arrows "C" and "D" diverge so that the stop formation (36) that is located on the side of the intermediate contact (24) radially remote from the axis of rotation of the arm will then release the squat cylindrical contact. It has been found that an additional delay can be achieved utilizing this expedient.

The second intermediate contact (35) also has a stop formation (39) that is arranged to arrest the movement of the squat cylindrical contact carried by the arm and thus of the arm, whilst the tension member (40) is restrained by its fuse. However, the entire pivotal carrier and tension element and contact fixed relative thereto will, subsequent to the tensioning element moving under its spring loading to clear the tension member and fuse remnants, rotate about the pivot (32) when the fuse has blown to allow the arm to rotate to the position in which the collapsible link collapses as described above.

Numerous variations can be made to the embodiments of the invention described above without departing from the scope hereof that is simply illustrative of the inventive principles.

The invention claimed is:

1. A fuse holder assembly comprising a body providing at least two electrically insulated fuse housings in the form of passages associated with the body and each adapted to receive a fuse held under tension therein by means of an elongate tension member, wherein the fuse housings have electrical contact means connected together at one end to a common first circuit contact for connecting one end of each fuse assembly into a circuit and at the other end with separate intermediate contacts adapted for sequential connection to a second circuit contact by way of a rotatable conductive arm spring loaded to effect rotation of the arm from one intermediate contact to the other;

stop means for temporarily maintaining the arm in association with one intermediate contact against the spring loading thereof wherein the stop means is releasable to allow the arm to rotate to a following intermediate contact after the fuse associated with the particular intermediate contact with which the arm communicates has blown;

a tensioning device associated with each passage at an end thereof corresponding to the intermediate contacts and comprising a spring loaded tensioning element for engaging the tension member associated with the fuse and adapted to move the tension member in a direction outwards of the associated passage in the event of the associated fuse being blown;

wherein the stop means and spring loaded tensioning element are arranged such that the stop means only releases the arm for movement towards the subsequent intermediate contact when the spring loaded tensioning element has substantially reached the end of its operative movement to clear the blown fuse.

2. A fuse holder assembly as claimed in claim 1 in which the arm carries a cooperant contact in the form of a generally squat cylindrical contact at its free end for cooperation with the associated intermediate contact.

3. A fuse holder assembly as claimed in claim 1 in which the spring loaded tensioning element in each case is a pivotally mounted element whereof the pivotal axis is offset from the axis of the associated fuse passage and the free end is, in the operative tension imparting condition, positioned roughly coaxial with the passage and is engaged by the tension member so as to move the latter out of the fuse passage when the tension member is released in consequence of the associated fuse blowing.

4. A fuse holder assembly as claimed in claim 1 in which the intermediate contact is, in each case, mounted to move in unison with the associated spring loaded tensioning element about a pivotal mounting thereof with the intermediate contact having a surface orientated in a plane offset from said passages and at generally right angles to the axis of the rotation of the spring loaded element and wherein the stop means is carried by the intermediate contact and disengagement of the stop means is delayed substantially until the movement of the spring loaded tensioning element to clear the blown fuse has been completed.

5. A fuse holder assembly as claimed in claim 4 in which the said axis of rotation of the spring loaded tensioning element is substantially coincides with the axis of the intermediate contact.

6. A fuse holder assembly as claimed in claim 1 in which the intermediate contact is, in each case, mounted to move in unison with a pivotal carrier that also carries the associated spring loaded tensioning element with the intermediate contact having a surface oriented in a plane offset from said passages and at generally right angles to the axis of rotation of the spring loaded tensioning element and wherein disengagement of the stop means and arm is achieved by pivotal movement of said pivotal carrier substantially subsequent to the spring loaded tensioning element having acted to clear the blown fuse.

7. A fuse holder assembly as claimed in claim 6 in which the axis of rotation of the pivotal carrier is offset in the general direction in which the associated passage extends.

8. A fuse holder assembly as claimed in claim 1 in which the stop means assumes the form of an upstanding stop fixed to the associated intermediate contact.

9. A fuse holder assembly as claimed in claim 1 in which the fuse assembly is a dropout fuse assembly wherein the final fuse in the sequence is arranged to cause dropout of the fuse assembly once the final fuse has blown.

10. A fuse holder assembly as claimed in claim 9 in which the rotatable arm is carried at one end of a rotatable axle assembly, the other end of which cooperates with a catch that is spring loaded to its open position and held in a closed position by the axle assembly and wherein the spring loaded catch operatively holds the dropout fuse assembly in an extended operative condition but causes collapse of a link held in its operative position by said spring loaded catch when the catch is released.

* * * * *